United States Patent [19]

Schmit

[11] 4,214,675

[45] Jul. 29, 1980

[54] LIQUID POUCH IN A CARTON WITH A POURING SPOUT

[76] Inventor: Justin M. Schmit, 126 Sea Island La., Boca Raton, Fla. 33432

[21] Appl. No.: 881,691

[22] Filed: Feb. 27, 1978

[51] Int. Cl.[2] ..... B67B 7/26; B67B 7/28

[52] U.S. Cl. ..... 222/83; 222/105; 222/183; 222/500; 222/525

[58] Field of Search ..... 222/105, 83, 83.5, 89, 222/90, 500, 183, 81, 566, 569, 525

[56] References Cited

U.S. PATENT DOCUMENTS

| | | | |
|---|---|---|---|
| 1,137,248 | 4/1915 | Whitney | 222/569 |
| 1,745,382 | 2/1930 | Rogers | 222/525 |
| 3,233,817 | 2/1966 | Casady | 222/105 X |
| 3,363,807 | 1/1968 | Powell | 222/105 |
| 3,493,146 | 2/1970 | Conners et al. | 222/566 X |
| 3,779,429 | 12/1973 | Porcelli | 222/500 |
| 3,930,286 | 1/1976 | McGowen | 222/105 X |

FOREIGN PATENT DOCUMENTS

| | | | |
|---|---|---|---|
| 472383 | 2/1929 | Fed. Rep. of Germany | 222/81 |

*Primary Examiner*—Robert J. Spar

*Assistant Examiner*—Frederick R. Handren

*Attorney, Agent, or Firm*—Schroeder, Siegfried, Ryan, Vidas, Steffey & Arrett

[57] ABSTRACT

This invention relates to a liquid containing pouch sealed in a carton with the pouch having a spout connected thereto. The spout projects through a hole in the carton and is secured to the carton. The pouch is sealed at the spout and is opened by means of a piercing device incorporated within the spout which is moved axially in the spout for opening the pouch. The piercing device is mechanically actuated through movement of a tubular portion of the spout telescopically fitted therein and carrying the piercing element. Further axial movement of the piercing device is obtained through rotatable movement between the spout and the tubular portion to fold flap portions of the pouch, pierced by the piercing element, such as to enable complete dispensing of liquids therefrom. The spout includes a valve which seals the pouch after opening by the piercing element such that liquid may be extracted from the pouch as the pouch is collapsed within the carton. The valve forms an airlock to restrict passage of air into the pouch during and after dispersing of liquids therefrom.

12 Claims, 6 Drawing Figures

LIQUID POUCH IN A CARTON WITH A POURING SPOUT

FIELD AND BACKGROUND OF INVENTION

This invention relates to a liquid containing pouch in a carton having a pouring spout with opening means connected thereto. The improved liquid pouch with pouring spout includes provisions for valve means to prevent entrance of air into the pouch after the pouch is opened.

Containers which include a flexible liquid containing pouch with a dispensing structure associated therewith or formed therein are generally old. Such pouches are normally attached to the container or carton for support. Examples of such prior constructions will be found in my prior U.S. Pat. Nos. 3,938,707; 3,995,773; 4,076,147; and in my pending U.S. appln. Ser. No. 817,816, filed July 21, 1977, now U.S. Pat. No. 4,165,023, and entitled STACKABLE CARTON.

Such prior structures have employed arrangements in which the dispensing structure is formed integral with the flexible pouch upon manufacture and the opening through the dispensing structure is made at the time of assembly of the dispensing structure on the pouch material. These structures are designed to counteract the problems of permeation of gas through the packaging which may be detrimental to the material or fluid packaged therein. However, certain fluids, such as wines or other alcoholic beverages, are also susceptible to contamination once the pouch is opened through the passage of air into the pouch as fluids are dispensed. Thus, the pouches with liquid therein do not collapse as fluids are dispensed due to the entrance of air therein and the presence of air in contact with the liquid in the pouch after reclosure has a deleterious effect on the liquid.

SUMMARY OF THE PRESENT INVENTION

My invention relates to an improved container for holding and dispensing fluids of the type which are susceptible to the presence of oxygen after the pouch is opened. The container includes a flexible pouch adapted to contain the fluid and it is mounted in the container in a sealed condition. The container or paper carton provides the strength and rigidity to hold the pouch during filling, storage and handling, and fluid is dispensed from the pouch through a dispensing spout. The pouch is made of a plastic laminant or plastic and a foil laminant which protects the contents against the deleterious effect of gases passing through the pouch after filling. The spout includes a means for opening the pouch at the time of usage. In addition, the dispensing pouch includes a valve type closure member which is operative upon tilt of the pouch to open the valve. The valve protects the liquids in the pouch against passage of gases and contamination through the dispensing spout between times of usage and after the pouch is opened. The improved dispensing structure is sealed to the closed pouch, such as by heat sealing or gluing, and the dispensing structure includes provisions for mounting the same on a carton or container to support the pouch therein.

The dispensing spout includes a tubular member carrying a piercing element which is movable relative to the spout to pierce the laminant of the pouch at the dispensing spout through axial movement of the tubular member and piercing element. Initial axial movement opens the pouch, and relative rotation between the tubular element and the piercing element further advances the piercing element into the pouch to fold the pierced portions and provide a clear exit of fluid therethrough. The valve in the dispensing spout is a ball type check valve which is opened upon tilt to the container to allow the passage of fluids therethrough and which closes when the container is returned to an upright position to seal the same against the entrance of air into the pouch. This permits the flexible pouch to collapse as liquids are dispensed therefrom and to insure that air is not permitted to enter the pouch through the dispensing spout.

DESCRIPTION OF PREFERRED EMBODIMENT

Figure 1:
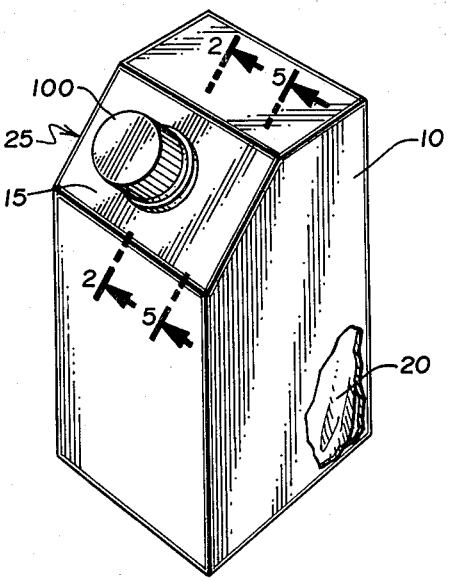
FIG. 1 is a perspective view of the improved container with the improved dispensing spout.

My improved container for dispensing fluids is shown in FIG. 1 as incorporating a carton 10 having a flexible liquid containing pouch 20 positioned therein to form the container for storage and dispensing of the fluids in the pouch. The supporting carton 10 may take varying forms and preferably may be made of a paper board with sealed bottom and top flaps which may be assembled conventionally in a variety of manners. The carton 10 may have a flat top or a composite flat and sloped portion such as is indicated at 15, in FIG. 1 to aid in the stacking of the cartons. The pouch has a pouring spout, indicated generally at 25, which projects through an aperture at the top of the carton and is secured thereto such as to support the pouch 20 within the carton. Similarly, the pouch will normally be positioned in the carton and filled and sealed through entrance at either the bottom or top flaps with the dispensing spout secured to the flaps after which the flaps are sealed to enclose the pouch. My prior U.S. Pat. No. 4,076,147 shows one method of mounting such a pouch in a carton.

Figure 2:
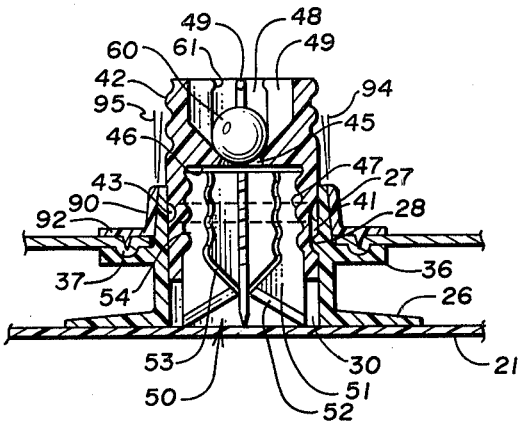
FIG. 2 is a sectional view of the container taken along the lines 2—2 in FIG. 1.

FIG. 2 shows the dispensing spout 25 and its connection to the pouch and the carton 10. The dispensing spout is preferably heat sealed or glued to a top surface 21 of the pouch 20, during the construction of the pouch. Such a pouch would normally be made of a film or sheet of plastic or other liquid impervious material which is sealed at the sides and the bottom. An entrance is provided for filling the pouch and this entrance is sealed after filling of the pouch.

The dispensing spout has a skirt portion 26 against which the top wall 21 of the pouch material is secured. Radially extending annular mounting flange 36 is located intermediate the extent of the spout and the mounting flange has grooved surfaces 37 along the upper side of the same. Spout 25 has a generally cylindrical opening 30 extending through the center of the same and a tubular member 40 is positioned therein to move telescopically with respect to the spout. The tubular member has a threaded exterior at the upper end of the same, as indicated at 42, and an axial groove 41 is positioned intermediate the axial extent of the same terminating in a circumferential groove 43. The circumferential groove extends from the axial groove 41 generally an angular distance of about 350°. A protrusion 28 is positioned in the wall of the inner recess or bore 30 of the spout and upon assembly of the tubular member therein, the protrusion 28 rides in the vertical or axial groove 41 of the tubular member permitting limited axial movement of the tubular member. When the protrusion is positioned at the upper end of the groove 41, the tubular member may be rotated as the protrusion 28 rides in the circumferential groove 43 substantially through an arc of about 350° or less than a complete turn, for purposes to be later noted.

Tubular member 40 has a recess opening 46 extending from one end of the same and common to the surface 21 of the pouch when assembled in the pouch. The recess 46 has a threaded surface 47 which mounts a piercing element, indicated generally at 50. The piercing element 50 is formed of thin, plate-like portions or plates 51 which are molded as a unit to define a generally cruciform structure. Two of the plates defining a lower set of edges provide the piercing surface. These plates have inwardly sloped knife surfaces 52 at the bottom edge of the same. A second set of plates 51 which are spaced intermediate the plates forming the lower set define a folding portion of the piercing element with outwardly sloped sides 53 for purposes to be later noted. The peripheral edges of the cruciform structure forming the piercing element have grooved surfaces 54 to define a threaded periphery adapted to cooperate with an internal threaded surface 47 of the recess 46 in the tubular member such that the piercing element may be threaded therein. Above the recess 46 is an orifice 45 or restriction in the flow passage from the recess 46 in the tubular member. Above the orifice 45 is a recessed surface 48 in which are positioned or molded a plurality of flute-like flanges 49 which act as guides or retainers for a ball check valve 60, positioned in the upper portion of the tubular member. The ball is adapted to seat in the orifice 45 to close the passage through the tubular member, and the clearances between the flute-like flanges 49 and the ball will permit the ball to slidably move therein and be retained in the tubular member through turned over portions 61 on the edges of the flute-like flanges 49.

When the dispensing spout is assembled, and prior to positioning the same on the top wall of the pouch, the tubular member 40 is positioned in the dispensing spout such that the tubular member is spaced from the skirt 26 and the ends of the piercing element carried thereby are disposed generally in the plane of the skirt so as not to project therefrom and touch the surface of the pouch as it is attached thereto. The dispensing spout is preferably made of a molded plastic material including a spout portion, tubular portion and the piercing element. After the dispensing spout has been attached to the top surface of the pouch, the pouch will be installed in the carton. The pouch may be filled and sealed before installation in the carton or it may be installed in the carton when empty and thereafter filled and sealed. The spout has a shoulder portion 27 above the flange 36 which projects through an aperture, not shown, in the top wall of the carton and a sleeve member 90 is telescopically fitted over the shoulder 27. The shoulder portion 27 has a slightly inclined taper, such as is indicated at 94, in FIG. 2. The sleeve member has similarly a complimentary inclined portion such as is indicated at 95 which telescopically fits on the surface of the shoulder 27 to provide a frictional fit therebetween. The sleeve has an outwardly extended flange portion 92 with pointed tabs designed to bite into the surface 15 of the carton surrounding the aperture and to secure the top portion of the carton therebetween. Thus, the dispensing element is secured to the top wall of the carton and supports the pouch therein. The tubular member is adapted to have a cap 100 with internal threads positioned over the threaded surface 42 of the tubular member to close the same before or after assembly of the pouch to the carton, the pouch may be filled and sealed. The open carton flaps are then sealed such that the carton encloses and supports the pouch with the liquid therein.

Figure 3:
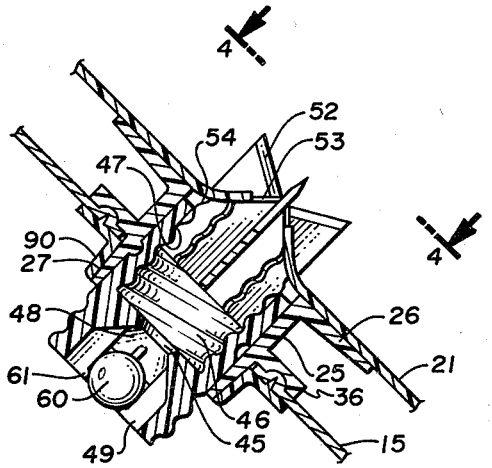
FIG. 3 is a view similar to FIG. 2 showing the dispensing spout in an open position.
Figure 4:
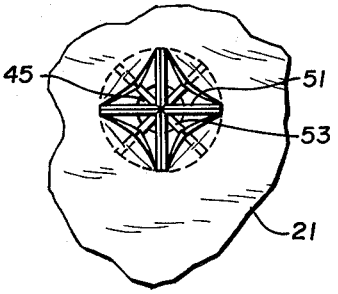
FIG. 4 is a sectional view of the piercing element taken along the lines 4—4 in FIG. 3.
Figure 5:
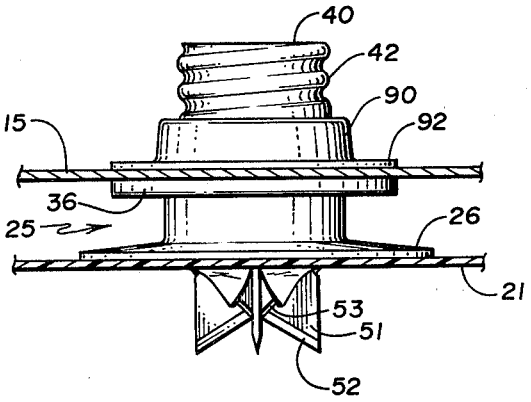
FIG. 5 is a sectional view of the container taken along the lines 5—5 in FIG. 1; and, FIG. 6 is a plan view of the dispensing spout.
Figure 6:
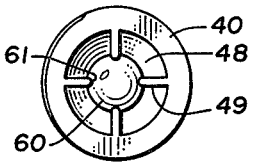

Whenever it is desired to open the pouch the piercing element is directed through the top wall 21 of the pouch by depressing the cover or tubular member 40 inwardly causing the tubular member to move relative to the spout as guided by the protrusion 28 in the groove 41. When the tubular member has been advanced as far as allowable by relative movement of the protrusion 28 in the groove 41, the lower end of the tubular member will be adjacent the surface of the pouch and the cutting surfaces 52 of the piercing element will cut cross-shaped slits in the top surface of the pouch. By rotating the tubular element such that the protrusion 28 rides in the groove 43, the piercing element, which is retained in position in the pouch, will be advanced axially due to relative rotation between the tubular element member and the piercing member through the threaded coupling. This will advance the piercing element further into the pouch and the portion of the second set of blades, as defined by the outwardly tapered surfaces 53, will fold the flap portions of the pouch which have been split, as indicated in FIG. 4, downwardly along the edges of the same. This will provide an opening in the top wall of the pouch, as indicated in FIG. 3 and FIG. 5. By removing the cap and tilting the carton, the liquid therein will move around the blades of the piercing element and through the orifice 45 unseating the ball 60 and allowing the liquid contents to be dispensed through the opening 48 in the upper portion of the tubular element. The liquid will cover the orifice so that no air will be allowed to enter the pouch, and the pouch will collapse as fluid is dispensed therefrom. With the carton returned to an upright position the ball 60 seats in the orifice 45 closing the same so that air will not be allowed to enter the pouch. This is particularly critical where the contents of the pouch is susceptible to the presence of oxygen once the pouch is opened. Liquids, such as wine or other liquids, to which the presence of oxygen has a deleterious effect may thus be sealed and dispensed without introducing air into the container after part of the fluid has been removed therefrom. The pierced portions of the top of the pouch when severed, cling to the piercing element. By spreading the flap portions with the second row of blades or plates of the piercing element, any tendency for the flap material to obstruct the flow of fluid through the the opening is prevented. The two stage piercing operation overcomes the obstacle of having portions of the flap material create an obstruction by first slitting the plastic film with the knife edges and then folding the film back so that liquid can flow at the surface of the film through the opening therein and at the juncture of the folds. Since the plastic film has a memory or tendency to return to its original form, it is necessary to keep the piercing element in a position in the opening to prevent the folds from obstructing flow. Thus, the piercing element with the improved dispensing spout provides sufficient travel of the piercing element to provide the functional opening. The use of the threaded relationship between the tubular member and piercing element makes it possible to keep the dispensing spout compact in design. The maintenance of such a low profile protects against damage of the dispensing spout and permits the use of the same on sloped structurally supported carton tops, such as is shown in FIG. 1, which are needed for warehousing and shipping.

With the use of the ball check in the dispensing assembly, the liquid pouch will be allowed to collapse as liquid is withdrawn therefrom. Previously this feature has been utilized in packaging materials where liquids have been dispensed through a valve at the bottom of the container. Wine and other foods have a tendency to spoil when exposed to air and this feature of preventing air from contacting the liquid in the pouch extends the useful life of the container for liquids of this type and permits the use of larger and more economical sized containers. The orifice restriction prevents air from moving freely into the pouch to replace liquid as it is poured and the pouch is allowed to collapse so that air cannot enter the same as liquid is dispensed. The cap 100 positioned on the spout when it is not in use, further prevents air from entering the pouch due to expansion of the pouch.

In considering this invention, it should be remembered that the present disclosure is illustrative only and the scope of the invention should be determined by the appended claims.

What I claim is:

1. A container for dispensing fluids comprising: a carton having sides defining a generally rectangular cross section with a sealed bottom and top end; said carton being made of paper material and having an aperture through the sealed top end, a flexible pouch of plastic material positioned in said carton, said pouch being formed with seamed edges defining sides and a top; a spout sealed to the top of the pouch, said spout having a flange surface projecting therefrom; a sleeve member positioned telescopically over the spout; said sleeve member having a flange surface which cooperates with the flange surface of the spout when the spout is positioned through the aperture in the carton to combine and bear against the inside and outside surfaces of the carton; a piercing element telescopically fitted within the spout to open the pouch, means movably mounting the piercing element within said spout to permit movement of the piercing member relative to the spout to open the pouch said means movably mounting said piercing element including a tubular member slidably positioned within said spout, means included in the mounting of the tubular member in the spout to advance the tubular member and the piercing element relative to the spout to pierce the pouch, and means included in said mounting of the piercing element for advancing the piercing element further into the pouch upon relative rotative motion between the tubular member and the piercing element.

2. The container of claim 1 in which the means movably mounting the piercing element within said spout includes a cooperating threading surface on the piercing element and on the surface of the tubular member to advance the piercing element further into the pouch upon relative movement between the piercing element and the tubular member.

3. The container of claim 1 in which the piercing element is formed of a plurality of radially extending and equally spaced blade members extending from the center of the piercing element with each radially extending blade member having knife edges which incline inwardly toward the center of the piercing element.

4. The container of claim 3 in which the piercing element is formed of two rows of radially extending blade members with the rows being separated circumferentially of the piercing element and the blade members of each row being equidistantly spaced from one another.

5. The container of claim 4 and including a removable cap positioned over the spout to close the pouch.

6. The container of claim 4 in which the radially extending blade members of the piercing element have threaded surfaces on the outer peripheral edges of the same and in which the tubular member has an inner threaded surface to mount the piercing element and advance the piercing element axially upon relative rotation between the tubular member and the piercing element.

7. The container of claim 1 and including valve means positioned in said spout and operative upon tilt of the carton to open a passage through the spout.

8. The container for dispensing fluids comprising: a supporting structure for a liquid containing pouch, means included in the supporting structure for mounting the pouch therein, a flexible pouch of plastic material positioned in said supporting structure, said pouch being formed of seamed edges defining sides and a top, a spout sealed to the top of the pouch, said spout being positioned through the mounting means of the supporting structure and attached thereto, a piercing element carried by the spout and movable relative to the pouch to open the pouch, an orifice means positioned in the spout, and a movable valve means seated in the orifice closing a passage through the spout, said valve means being operative to open the orifice by tilting of the supporting structure, said spout having a tubular member telescopically positioned therein and carrying the piercing element, means included in the mounting of the tubular member in the spout to permit the tubular member to advance axially with respect to the spout to pierce the pouch, and means included in the mounting of the piercing element on the tubular member to further advance the piercing element into the pouch upon relative rotative movement between the piercing element and the tubular member.

9. The container of claim 8 in which the movable valve means is a ball closure member slidably positioned in the tubular member for movement toward and away from the orifice with means for retaining the ball closure member in the tubular member.

10. The container of claim 9 in which the tubular member and spout form telescopic parts and in which one of the parts has an axial groove therein connected to a circumferential groove and with the other part having protrusion means adapted to ride in the grooves to provide an axial and rotative movement between the parts.

11. The container of claim 10 and including a removable cap positioned over the tubular member to close the pouch.

12. A container for dispensing fluids comprising: a supporting structure for a liquid containing pouch, means included in the supporting structure for mounting the pouch therein, a flexible pouch of plastic material positioned in said supporting structure, said pouch being formed of seamed edges defining sides and a top, a spout sealed to the top of the pouch, said spout being positioned through the mounting means of the supporting structure and attached thereto, a piercing element telescopically fitted within the spout to open the pouch, said piercing element being carried by a tubular member slidably positioned in the spout, means included in the mounting of the tubular member in the spout to permit the tubular member and the piercing element to advance relative to the spout to slit the pouch, and means included in the mounting of the piercing element on the tubular member to advance the piercing element further into the pouch upon relative motion between the tubular member and piercing element to fold the slit portion of the pouch.

* * * * *